US006940453B2

(12) United States Patent
Kim

(10) Patent No.: US 6,940,453 B2
(45) Date of Patent: Sep. 6, 2005

(54) APPARATUS AND METHOD FOR CALIBRATING RECEPTION SIGNAL IN MOBILE COMMUNICATION SYSTEM

(75) Inventor: Young-Jae Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 11 days.

(21) Appl. No.: 10/822,008

(22) Filed: Apr. 12, 2004

(65) Prior Publication Data

US 2004/0217902 A1 Nov. 4, 2004

(30) Foreign Application Priority Data

Apr. 29, 2003 (KR) ..... 10-2003-0027164

(51) Int. Cl.[7] ..... H01Q 3/22
(52) U.S. Cl. ..... 342/368; 342/174
(58) Field of Search ..... 342/165, 173, 342/174, 368, 372, 373

(56) References Cited

U.S. PATENT DOCUMENTS

| | | | | | |
|---|---|---|---|---|---|
| 3,727,223 | A | * | 4/1973 | O'Meara | 250/201.9 |
| 4,166,274 | A | * | 8/1979 | Reudink et al. | 342/376 |
| 4,725,844 | A | * | 2/1988 | Goodwin et al. | 342/374 |
| 5,117,377 | A | * | 5/1992 | Finman | 703/2 |
| 5,807,257 | A | * | 9/1998 | Bridges | 600/430 |
| 6,058,318 | A | | 5/2000 | Kobayakawa et al. | |
| 6,157,340 | A | | 12/2000 | Xu et al. | |
| 6,208,287 | B1 | | 3/2001 | Sikina et al. | 342/174 |
| 6,236,839 | B1 | * | 5/2001 | Gu et al. | 455/67.14 |
| 6,480,153 | B1 | | 11/2002 | Jung et al. | |
| 6,784,838 | B2 | * | 8/2004 | Howell | 342/377 |
| 2002/0089447 | A1 | | 7/2002 | Li | 342/368 |

FOREIGN PATENT DOCUMENTS

| | | | |
|---|---|---|---|
| EP | 1104122 | A1 | 5/2001 |
| EP | 1 161 002 | A1 | 12/2001 |
| EP | 1187354 | A1 | 3/2002 |
| GB | 2 342 505 | A | 4/2000 |
| JP | 11-312917 | | 11/1999 |
| JP | 2000-216618 | | 8/2000 |
| JP | 2001-156688 | | 6/2001 |
| JP | 2001-332925 | | 11/2001 |
| JP | 2001-352282 | | 12/2001 |
| KR | 1020010088416 | | 9/2001 |
| WO | 2003-0015388 | | 2/2003 |

* cited by examiner

*Primary Examiner*—Dao Phan
(74) *Attorney, Agent, or Firm*—Fleshner & Kim, LLP

(57) ABSTRACT

A method for calibrating a reception signal in a smart antenna system includes: locally generating a reference signal, converting the reference signal into an RF signal, and dividing the RF signal into as many signals as the number of antennas.

Phase information of the divided RF signals is then detected. This is followed by outputting a plurality of reference signals having the same phases by performing phase shifting operation, converting an RF signal into a baseband signal, and calibrating the baseband signal by multiplying the baseband signal by a calibration vector. An apparatus for calibrating a reception signal in a smart antenna system includes a reference signal generating unit and an array antenna unit. The reference signal generating unit includes a local reference signal generator, an RF converter, a splitter, a phase detector, and a phase shifter. The array antenna unit includes an antenna, a front-end part, an RF transmitter, an RF receiver, and a baseband processor. A process of calculating complex conjugate numbers and a complex conjugate number calculator may also be included. In this method, because the same reference signals are input into the array antenna unit, the calibration process may be greatly simplified.

20 Claims, 3 Drawing Sheets

APPARATUS AND METHOD FOR CALIBRATING RECEPTION SIGNAL IN MOBILE COMMUNICATION SYSTEM

BACKGROUND OF THE INVENTION

1. Field of the Invention

The present invention generally relates to mobile communication systems, and particularly to an apparatus and method for calibrating a reception signal in a Smart Antenna System.

2. Background of the Related Art

Performance and capacity in a mobile communication system is fundamentally controlled by radio wave channel characteristics, such as same channel interference generated between cells or within a cell, path attenuation, multipath fading, delay of a signal, Doppler spectrum, and shadow phenomenon.

Currently, mobile communication systems apply a plurality of techniques including power control, channel coding, RAKE reception, a Diversity antenna, cell sectorization, frequency division, spread spectrum and the like as compensation techniques in an attempt to overcome limitations on performance and capacity. However, as mobile communication services gradually become diversified, demand for these services greatly increases. It is therefore considered that it will gradually be more difficult to satisfy increasing needs for high performance and high capacity of a mobile communication system with only existing techniques.

In addition, compared to existing cellular phones and personal portable communications, $21^{st}$ century mobile communication systems will provide multimedia communication services requiring high quality and much greater capacity, and even for tone quality these systems will be required to offer high-quality voice service which is at least as good as the tone quality in wire communications. Also, in a mixed cell environment in which various service signals are mixed, $21^{st}$ mobile communication systems will have to attenuate the effects of strong interfering signals due to high-speed data which have transmission power and transmission bandwidth which are relatively great. Mobile communication systems will also have to provide satisfactory service in so-called hot spot or shadow areas.

In an attempt to overcome performance degradation due to interfering signals and other channel characteristics, a smart antenna has been used and evaluated as a prospective core technique for widespread use in commercial systems.

Unlike the case where multipath signals are coupled by two existing diversity antennas, in a smart antenna system an array antenna having a plurality of antenna sensors is used, where the sensors are arranged at certain intervals and an advanced high performance digital signal processing in baseband is used. The smart antenna increases a degree of freedom in design by adding space processing capability to the mobile communication system, thereby improving the entire performance of the system. That is, instead of emitting an omnidirectional beam, a smart antenna emits a directional beam to only an affected subscriber so that interference between signals is minimized for all subscribers who are operating in a sector. This results in an increase in communication quality and system's channel capacity.

When communicating using a related-art smart antenna system, a receiver calculates a weight vector needed in a signal process or extracts a specific parameter of a channel such as direction of arrival (DOA) or the like, based on a received signal. If characteristics of each antenna are different, accuracy in a signal process is degraded. A calibration method for maintaining characteristics of each receiver should therefore be performed.

In general, there are two related-art calibration methods. One uses a reference path and the other uses a locally generated reference signal. In the method which uses the reference path, a received signal passes through a reference path and an array to be calibrated at the same time. Then, using the signal which passed through the reference path as a reference, values for calibrating the array are obtained using an algorithm such as LMS (Least Mean Square) or NLMS (Normalized LMS).

The LMS is a representative algorithm of adaptive filtering and is similar to an adaptive filter coefficient algorithm which has been developed by Widrow. But, unlike the Widrow filter, in the LMS, Mean Squared errors (MSE) have no two-dimensional factor, and therefore the LMS shows excellent performance simplifying an algorithm structure and in a calculating speed for data processing.

The NLMS is an algorithm performed based on a plurality of adaptive filters, and more specifically which controls a convergence constant that affects convergence speed and stability of the adaptive filters, and then plans an optimum filter in a system by controlling a convergence constant which affects fast convergence of adaptive filter coefficients in order to overcome system degradation due to a fixed convergence constant. Also, the NLMS is representative algorithm of a method where a convergence constant is changed into a proper value in every sample by power of an inputted signal which is repeatedly calculated.

Through the methods of using the algorithms and the reference path, the output of the array and the output of reference RF (Radio Frequency) are maintained the same. However, this method has a defect in that the reference signal is unstable.

FIGS. 1*a* and 1*b* illustrate a calibration process in which a locally generated signal is used as a reference signal. With reference to FIG. 1*a,* in order to generate a reference signal, an RF transmission block 10 is positioned outside of an array. An output generated from the RF block is input into a splitter 20. The output passes through the splitter and is divided into several signals (1:N). The divided signals are then input into respective portions of an array 30.

If an ideal splitter is used, the size and phase of each divided signal has to be the same. Accordingly, if an error of the splitter is ignored, since the same signals are inputted to the array, it is very easy to discover and calibrate an error generated at the array.

An actual splitter is different from the ideal one, so the signals output from the splitter have sizes and phases which are different from each other. That is, when a signal output from array 30 is measured after a signal has been input to an array 30 via RF block 10 and splitter 20, inherent errors of the splitter and the array are mixed in the output signal, and so the error of array 30 cannot be calibrated.

In order to properly calibrate the error of the array, the error of the splitter first has to be calibrated. Therefore, as shown in FIG. 1*b,* a complicated process of measuring an output of the array has to be performed twice; that is, an output of the array is measured and then the output of the array is measured again with a cable changed.

Through the twice-performed process of measuring the output, an inherent error of the splitter is detected and calibrated and then an error of the receiver is calibrated, thereby maintaining the same characteristics of the array.

In the smart antenna system calibrating process described above, the method of using a reference path is defective because the reference signal itself is unstable. Consequently, it is difficult to perform accurate calibration. Also, the method of using a locally generated reference path is defective, because a complicated measuring process has to be performed twice in order to calibrate an error generated when a signal passes through a splitter.

SUMMARY OF THE INVENTION

An object of the present invention is to solve one or more problems of the related-art and/or to achieve at least one of the following advantages.

Another object of the present invention is to provide an apparatus and a method for calibrating a reception signal in a mobile communication system, which calibration improves performance of the entire system by calibrating different characteristics of RF paths of each antenna in an array antenna.

To achieve these and other advantages and in accordance with the purpose of the present invention, as embodied and broadly described herein, there is provided an apparatus for calibrating a reception signal in a mobile communication system which according to one embodiment of the present invention includes a reference signal generating unit for outputting a plurality of reference signals having the same phases by calibrating a phase of a signal which is locally generated; and an array antenna unit for receiving a radio signal through a plurality of antenna paths by using a plurality of reference signals, and calibrating distortion of each array antenna path.

Preferably, the reference signal generating unit includes a local reference signal generator for locally generating a reference signal; an RF converter for converting the reference signal into an RF signal; a splitter dividing the RF signal as many as the number of antennas; a phase detector for detecting phase information of the divided signals; and a phase shifter for uniformly controlling a phase of the divided signals according to the phase information.

Preferably, the array antenna unit includes a plurality of antennas for receiving a radio signal; a front-end part for receiving a reference signal outputted from the reference signal generating unit and a radio signal received at the antennas; an RF transmitter for converting a baseband signal into an RF signal, and transmitting to the front-end part; an RF receiver for converting the RF signal inputted thereto via the front-end part into a baseband signal; and a baseband processor for receiving the baseband signal and calibrating the received baseband signal.

In accordance with another embodiment, a method for calibrating a reception signal in a mobile communication system includes outputting a plurality of reference signals having the same phases by calibrating a phase of a signal which is locally generated; receiving a radio signal through a plurality of antenna paths by using the plurality of reference signals, and converting the received radio signal into a baseband signal; and calibrating the baseband signal.

Preferably, calibrating the baseband signal includes setting a radio signal received through one antenna path as a reference; and multiplying a radio signal inputted through the other antenna path by a calibration vector of the radio signal set as a reference.

The present invention may further include a process of calculating complex conjugate numbers from the detected phase information, and a complex conjugate calculator for calculating the complex conjugate numbers.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

DETAILED DESCRIPTION OF PREFERRED EMBODIMENTS

The present invention is preferably implemented for use in a smart antenna system, however, the invention may also be implemented in other mobile communication systems including any one in which a signal is transmitted and received using an array antenna.

Figure 1A:
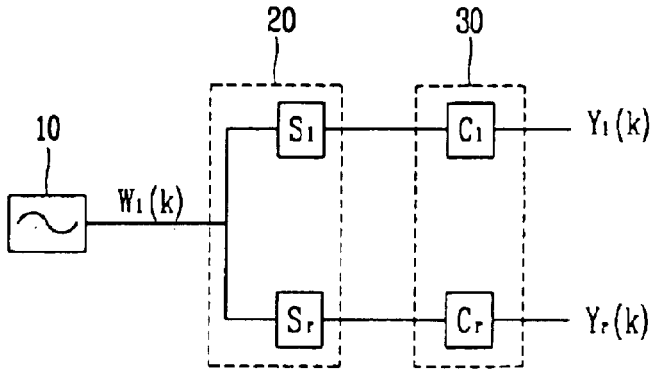
FIG. 1A RELATED ART
FIG. 1 is a view illustrating a related-art calibration method of using a locally generated signal as a reference signal.
Figure 1B:
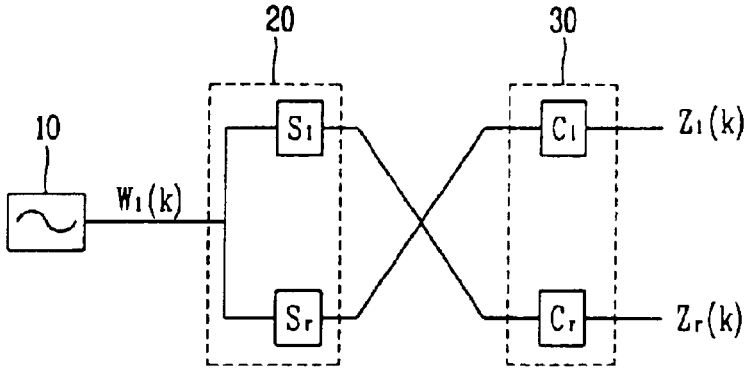
FIG. 1B RELATED ART
Figure 2:
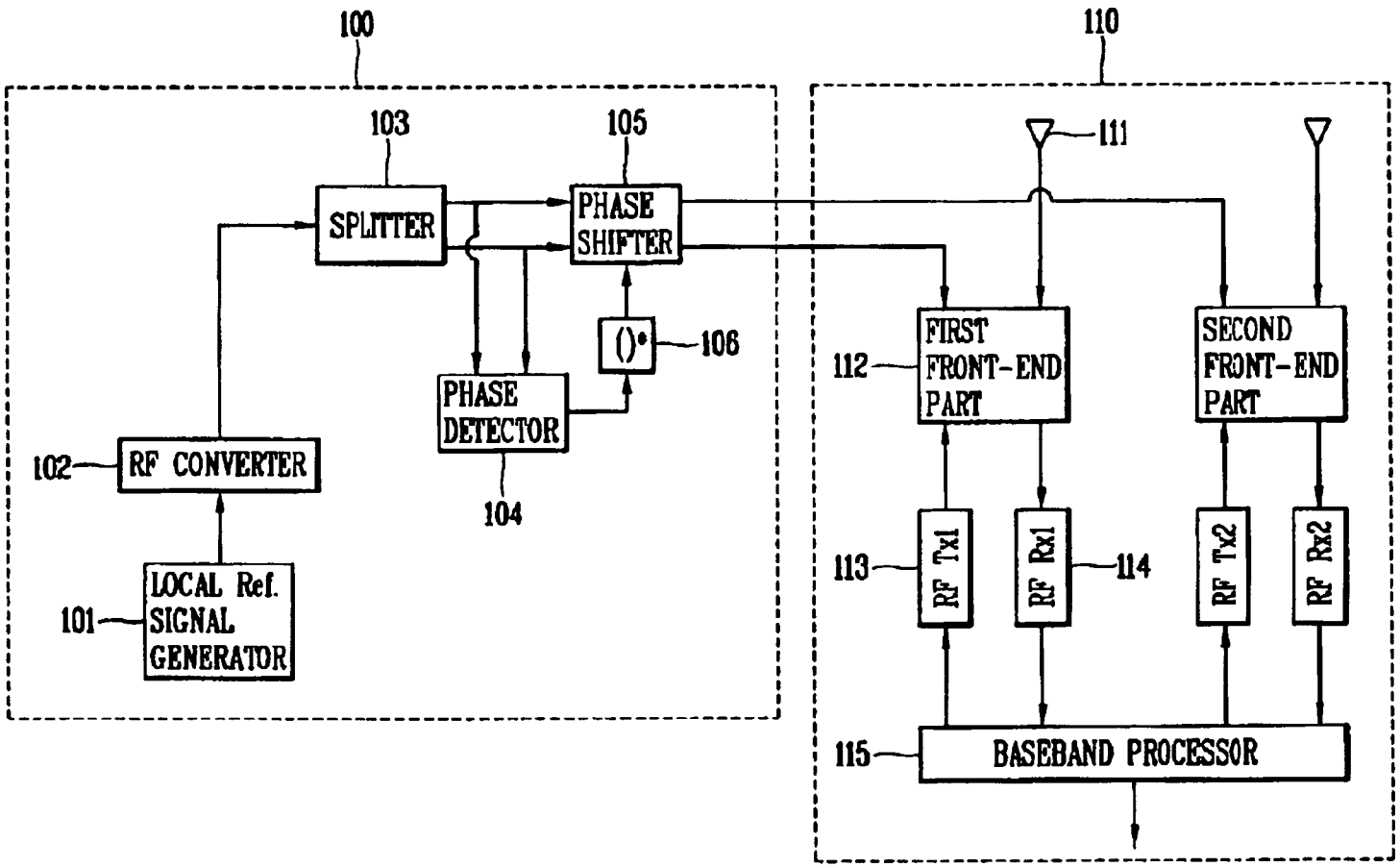
FIG. 2 is a view illustrating an internal structure of an apparatus for calibrating a reception signal in a mobile communication system according to one embodiment of the present invention.

FIG. 2 is a view illustrating an internal structure of a reception signal calibrating apparatus for a mobile communication system according to one embodiment of the present invention. The apparatus includes a reference signal generating unit 100 and an array antenna unit 110.

The reference signal generating unit 100 includes: a local reference signal generator 101 for generating a reference signal for calibration; an RF converter 102 for converting the reference signal into an RF signal; a splitter 103 for dividing the RF signal preferably into as many signals as the number of antennas in the array; a phase detector 104 for detecting phase information of the divided signals; and a phase shifter 105 uniformly controlling phases of the divided signals according to the phase information. The reference signal generating unit 100 further includes a complex conjugate number calculator 106 for calculating complex conjugate numbers of the signals according to the detected phase information.

The local reference signal generator 101 generates a reference signal for calibrating a smart antenna system, and the RF converter 102 performs frequency conversion of converting a baseband signal generated at the local reference signal generator 101 into an actual RF signal.

The splitter 103 divides the RF signal output from the RF converter 102 into as many signals as the number of antennas. That is, in case of a system in which N-antennas are used, the RF signal is divided into N-signals by using a 1:N splitter.

The phase detector 104 detects phases of the RF signals output from the splitter 103, and makes the phase shifter 105 control the phase of the signal uniformly according to the detected phase information.

After the phase detector 104 detects the phases of the signals, the complex conjugate number calculator 106 calculates complex conjugate numbers of the signals in order to control the detected phases of the signals. But, use of the complex conjugate number calculator 106 is selective.

Therefore, if the phases of the signals outputted from the splitter 103 can be the same without calculating the complex conjugate numbers, the complex conjugate number calculator 106 is not needed. Herein, the complex conjugate number is that if the signal is 1+2i, the complex conjugate number of the signal becomes $\overline{1+2i}=1-2i$ and can be referred to as a bar.

The phase shifter 105 uniformly control the phases of the signals. The phase shifter 105 uniformly controls the phases using phase information detected from the phase detector 104 as above, or uniformly controls the phases by multiplying an RF signal by the complex conjugate number obtained by the complex conjugate calculator 106. No matter what kind of method is used, the phase shifter 105 calibrates a phase error generated when the signals pass through the splitter 103 and makes the reference signals have the same phases input into a front-end part 112.

Each RF signal generated at the reference signal generating unit according to the present invention is input into a front-end part connected to each antenna 111, having the same phases, and goes into a baseband processor 115 via an RF receiver (RF Rx) 114.

In the related-art method, because the reference signals which have passed through a splitter are different from each other, the measuring process is performed twice. But in the present invention, the same reference signals are input into the array antenna unit 110, thereby simply performing calibration. Herein, the array antenna unit is considered as one block including an antenna 111, a front-end part 112, an RF transmitter (Rx Tx) 113, the RF Rx 114 and a baseband processor 115 which are illustrated on the right side of the FIG. 3.

The RF RX 114 converts a reference signal which has been inputted via the front-end part 112 of the array antenna unit, into a baseband signal. The baseband processor 115 receives the baseband signal and performs calibration to make the receiving characteristics the same.

Figure 3:
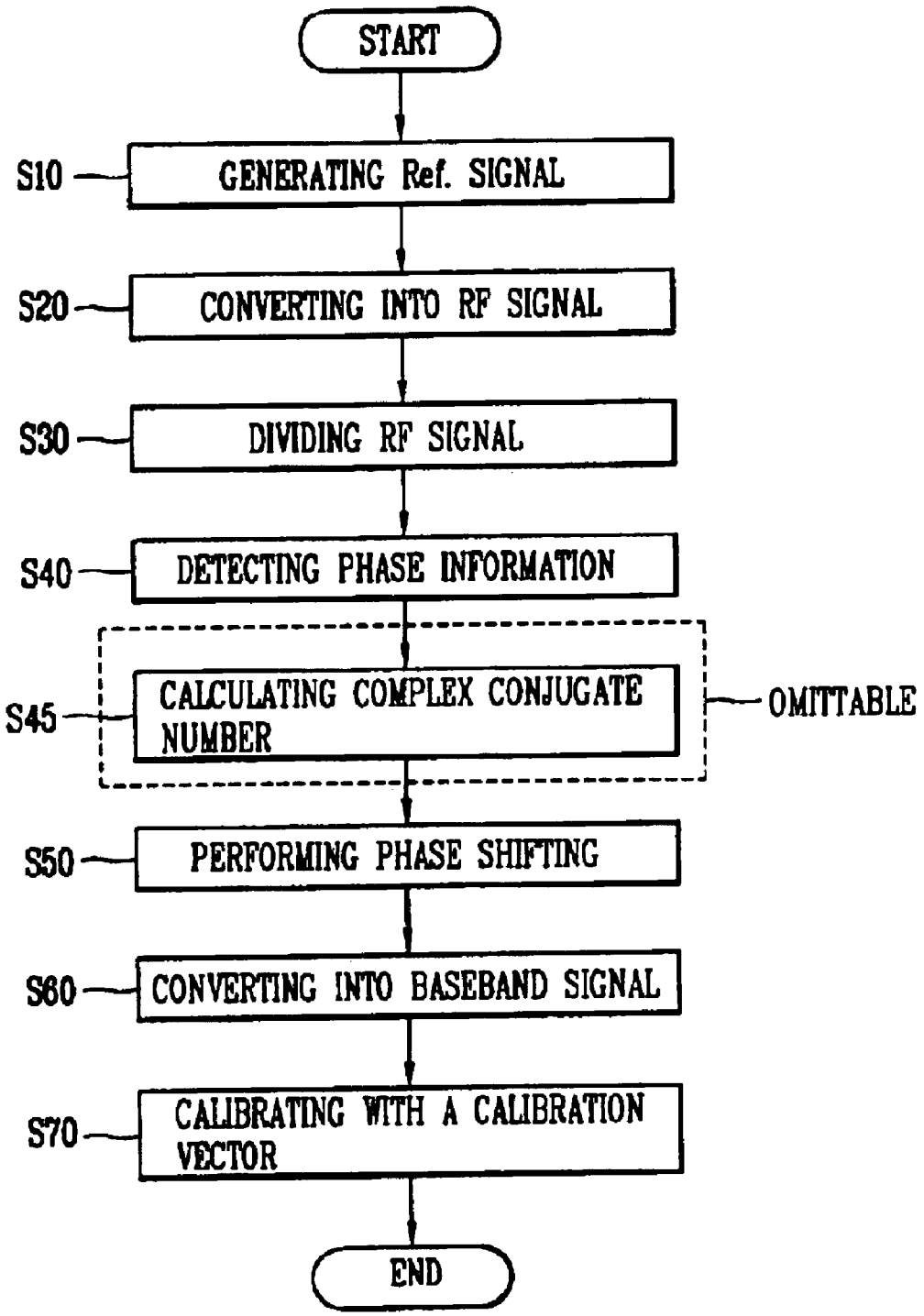
FIG. 3 is a view illustrating a process of a method for calibrating a reception signal in a mobile communication system according to one embodiment of the present invention.

FIG. 3 is a flowchart illustrating a process of a method for calibrating a reception signal in a mobile communication system according to an embodiment of the present invention. When reception is started at a base station, a reference signal for calibrating a reception signal is generated from a reference signal generator (S10). Then, the generated reference signal is input into an RF converter and the input reference signal is converted into an RF signal to be outputted (S20). Thereafter, the output RF signal is input into a splitter, and the RF signal is divided into as many signals as the number of antennas (S30). At this time, an error occurs where the sizes and phases of the signals output from the splitter are different from each other.

In order to calibrate the error first, phase information of RF signals which have been outputted from the splitter is detected (S40). Using this phase information, phase shifting for uniformly controlling the phases of the signals is performed (S50). Before the phase shifting is performed, a process (S45) of calculating complex conjugate numbers based on the phase information may be selectively added. At this time, the phase shifting which uniformly controls the phases of the signals is performed by multiplying the RF signals by the complex conjugate numbers obtained in the process (S45).

The signals which have been through the above process are input into an RF receiver via a front-end part, and is converted into a baseband signal (S60). At this time, all signals which have experienced the phase shifting are the same. Therefore, theoretically, the baseband signals that are converted by the receiver should be the same. But, since receiving characteristics of each RF receiver are different from each other, the actually outputted baseband signals are different from each other too. Accordingly, calibration for making the receiving characteristics the same has to be performed. In order to calibrate outputs of each antenna, a calibration vector and the baseband signal are multiplied to make outputs of each antenna the same as an output of a reference antenna (S70).

The method of calibrating the outputs of the antennas by multiplying the baseband signal by the calibrating vector will now be described, on the assumption that there are four RF Rxs (in FIG. 3, two RF Rxs are illustrated). If there are four RF Rxs, there are four baseband signals, for example, four baseband signals of a, b, c, d. When one specific antenna is designated as a reference antenna for calbiration, (e.g., when 'a' is designated as a reference antenna and a baseband signal which corresponds to the reference antenna is referred to as 'a'), a calibration vector for calibrating outputs of each antenna becomes [1, a/b, a/c, a/d]. An expression of multiplying an original signal by this calibration vector is provided below:

$$[a \quad b \quad c \quad d]\cdot\begin{bmatrix}1\\a/b\\a/c\\a/d\end{bmatrix}=[a \quad a \quad a \quad a]$$

Accordingly, outputs of each antenna become the same as the output (a) of the reference antenna. This is acheived by multiplying the baseband signal by the calibration vector, so that reception characteristics of reception parts (RF Rx) of the array antenna can be maintained the same.

As so far described, an apparatus and a method for calibrating a reception signal for a mobile communication system according to the present invention leaves out a complicated measuring process for calibrating an error while a locally generated reference signal is still used in calibrating process for a smart antenna, and calibrates an error of signals which have passed through a splitter to generate the same reference signals, thereby simply calibrating each receiver of an array antenna.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An apparatus for calibrating a reception signal of an array antenna in a mobile communication system, comprising:

a reference signal generator which outputs a plurality of reference signals having same phases, by calibrating a phase of a locally generated signal; and an antenna array which receives a radio signal through a plurality of antenna paths by a plurality of reference signals, and calibrating distortion of each array antenna path, wherein the reference signal generating unit comprises:

a splitter which divides an RF signal into as many signals as a number of antennas in the array;

a phase detector which detects phase information of the divided signals; and a phase shifter which uniformly controls phases of the divided signals based on the phase information.

2. The apparatus of claim 1, wherein the reference signal generating unit further comprises:

a local reference signal generator which locally generates a reference signal; and an RF converter which converts the reference signal into the RF signal.

3. The apparatus of claim 1, wherein the reference signal generator further comprises a complex conjugate number calculator.

4. The apparatus of claim 3, wherein the complex conjugate number calculator calculates complex conjugate numbers of the divided RF signals.

5. The apparatus of claim 1, wherein the antenna array comprises:

a plurality of antennas for receiving a radio signal;

a front-end part for receiving a reference signal outputted from a reference signal generator and a radio signal received by the antennas;

an RF transmitter for converting a baseband signal into an RF signal and transmitting the RF signal to the front-end part;

an RF receiver for converting the RF signal into a baseband signal; and a baseband processor calibrating the baseband signal.

6. The apparatus of claim 5, wherein the baseband processor sets a radio signal received through one antenna path as a reference, and multiplies a radio signal received through the other antenna path by a calibration vector of the radio signal set as a reference, thereby performing calibration.

7. The apparatus of claim 1, wherein the antenna array comprises a smart antenna system.

8. A method for calibrating a reception signal of an array antenna system in a mobile communication system, comprising:

outputting a plurality of reference signals having same phases by calibrating a phase of a locally generated signal;

receiving radio signals through a plurality of antenna paths using the plurality of reference signals, and converting the radio signals into baseband signals; and calibrating the baseband signals, wherein outputting the plurality of reference signals comprises:

dividing an RF signal into a number of signals;

detecting phase information of the divided signals; and outputting a plurality of reference signals having the same phases by performing phase shifting after the phase information is detected.

9. The method of claim 8, wherein outputting the plurality of reference signals further comprises:

locally generating a reference signal; and converting the reference signal into an RF signal.

10. The method of claim 8, wherein outputting a plurality of reference signals comprises calculating complex conjugate numbers.

11. The method of claim 8, wherein dividing the RF signal includes dividing the RF signal into as many signals as a number of antennas.

12. The method of claim 8, wherein the phase shifting is performed by uniformly calibrating phases of signals using one of phase information and complex conjugate numbers.

13. The method of claim 12, wherein calibrating phases using the complex conjugate numbers includes multiplying each divided RF signal by a complex conjugate number of said each signal.

14. The method of claim 8, wherein calibrating the baseband signal comprises:

setting a radio signal received through one antenna path as a reference; and multiplying a radio signal inputted through the other antenna path by a calibration vector of the radio signal set as a reference.

15. A calibration apparatus, comprising:

a splitter configured to split an RF converted local ref signal into a plurality of signals;

a phase detector configured to detect phases of the plurality of signals; and a phase shifter configured to shift a phase of the plurality of signals to be the same based on the detected phases, and to output the plurality of signals having the same phases to an antenna array.

16. The apparatus of claim 15, further comprising:

a local reference signal generator which locally generates a reference signal;

an RF converter which converts the reference signal into the RF signal; and a complex conjugate number calculator disposed between the phase detector and the phase shifter.

17. The apparatus of claim 16, wherein the complex conjugate number calculator calculates complex conjugate numbers of the divided RF signals.

18. The apparatus of claim 16, wherein the antenna array comprises:

a plurality of antennas for receiving a radio signal;

a front-end part for receiving a reference signal outputted from a reference signal generator and a radio signal received by the antennas;

an RF transmitter for converting a baseband signal into an RF signal and transmitting the RF signal to the front-end part;

an RF receiver for converting the RF signal into a baseband signal; and a baseband processor calibrating the baseband signal.

19. The apparatus of claim 18, wherein the baseband processor sets a radio signal received through one antenna path as a reference, and multiplies a radio signal received through the other antenna path by a calibration vector of the radio signal set as a reference, thereby performing calibration.

20. The apparatus of claim 15, wherein the antenna array comprises a smart antenna system.

* * * * *